US007185635B2

(12) United States Patent
Frank et al.

(10) Patent No.: US 7,185,635 B2
(45) Date of Patent: Mar. 6, 2007

(54) HIGH-PRESSURE ACCUMULATOR FOR FUEL INJECTION SYSTEMS WITH INTEGRATED PRESSURE CONTROL VALVE

(75) Inventors: Kurt Frank, deceased, late of Schorndorf (DE); by Claudia Esther Frank, legal representative, Schorndorf (DE); by Simone Christel Frank, legal representative, Schorndorf (DE); by Verena Andrea Frank, legal representative, Schorndorf (DE); Werner Wagner, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 134 days.

(21) Appl. No.: 10/515,293

(22) PCT Filed: Feb. 18, 2003

(86) PCT No.: PCT/DE03/00486

§ 371 (c)(1),
(2), (4) Date: Nov. 22, 2004

(87) PCT Pub. No.: WO03/100247

PCT Pub. Date: Dec. 4, 2003

(65) Prior Publication Data

US 2006/0102150 A1 May 18, 2006

(30) Foreign Application Priority Data

May 23, 2002 (DE) ..... 102 22 895

(51) Int. Cl.
*F02M 37/04* (2006.01)

(52) U.S. Cl. ..... 123/456; 123/514; 123/447; 123/506; 123/467; 123/458

(58) Field of Classification Search ..... 123/456, 123/514, 447, 506, 467, 458
See application file for complete search history.

(56) References Cited

U.S. PATENT DOCUMENTS

| | | | | |
|---|---|---|---|---|
| 3,827,409 | A * | 8/1974 | O'Neill | 123/458 |
| 4,870,940 | A * | 10/1989 | Filippi et al. | 123/506 |
| 5,025,768 | A * | 6/1991 | Eckert | 123/506 |
| 6,230,992 | B1 * | 5/2001 | Arndt et al. | 239/585.1 |
| 6,305,355 | B1 * | 10/2001 | Hoffmann et al. | 123/467 |
| 6,447,273 | B1 * | 9/2002 | Nishimura et al. | 417/505 |
| 6,595,238 | B2 * | 7/2003 | De Matthaeis | 137/539 |
| 6,672,290 | B2 * | 1/2004 | Ricco | 123/514 |
| 6,675,774 | B2 * | 1/2004 | Frank et al. | 123/456 |
| 6,679,475 | B2 | 1/2004 | Rembold et al. | |
| 6,761,149 | B2 * | 7/2004 | Frank | 123/456 |
| 7,007,672 | B2 * | 3/2006 | Condemine et al. | 123/447 |
| 2001/0029930 | A1 * | 10/2001 | Banzhaf | 123/499 |

FOREIGN PATENT DOCUMENTS

| | | |
|---|---|---|
| DE | 199 52 774 A1 | 5/2001 |
| DE | 100 16 242 A1 | 10/2001 |
| DE | 101 07 115 A1 | 9/2002 |
| DE | 101 25 944 A1 | 12/2002 |

* cited by examiner

*Primary Examiner*—Carl S. Miller
(74) *Attorney, Agent, or Firm*—Ronald E. Greigg

(57) ABSTRACT

A fuel injection system for internal combustion engines includes a high-pressure accumulator acted on with highly pressurized fuel by a high-pressure delivery unit and in turn supplies fuel to fuel injectors. The fuel injection system has a pressure control valve, which is disposed between a high-pressure side and a low-pressure side and actuating a valve element. The pressure control valve is actuated by means of an electrical actuator. An end surface of the pressure control valve delimits the low-pressure region in the high-pressure accumulator and is sealed by means of a seal disposed on the low-pressure side.

17 Claims, 4 Drawing Sheets

HIGH-PRESSURE ACCUMULATOR FOR FUEL INJECTION SYSTEMS WITH INTEGRATED PRESSURE CONTROL VALVE

CROSS-REFERENCE TO RELATED APPLICATIONS

This application is a 35 USC 371 application of PCT/DE 03/00486 filed on Feb. 18, 2003.

BACKGROUND OF THE INVENTION

1. Field of the Invention

In addition to unit injectors and unit pumps, modern autoignition internal combustion engines use accumulator injection systems for injecting fuel. These accumulator injection systems include a high-pressure accumulator that is supplied with highly pressurized fuel by a high-pressure pump. The high-pressure pump represents the interface between the high-pressure part and the low-pressure part of injection system. The high-pressure pump can be associated with a pressure control valve, which on the one hand, opens when the pressure in the high-pressure accumulator is too high, thus allowing fuel to flow out of this accumulator via a manifold and back to the fuel tank and on the other hand, when the pressure in the high-pressure accumulator is too low, seals the high-pressure side off from the low-pressure side.

2. Prior Art

The publication "Diesel Motor Management", 2$^{nd}$ updated and expanded edition, Vieweg 1989, Braunschweig; Wiesbaden, ISBN 3-528-03873-X, page 270, FIG. 9 has disclosed a pressure control valve used in a high-pressure pump, see page 267, FIG. 7. The pressure control valve includes a ball valve, which has a ball-shaped closing body. The pressure control valve contains an armature that is acted on by a compression spring at one end and is acted on by an electromagnet at the opposite end. For lubrication and cooling, fuel circulates around the armature of the pressure control valve.

If the pressure control valve is not actuated, then the high pressure prevailing in the high-pressure accumulator or at the outlet of the high-pressure pump also travels to the pressure control valve via the high-pressure supply line. Since the electromagnet exerts no force when it is without current, the high-pressure force overcomes the force of the compression spring, causing the pressure control valve to open; the pressure control valve remains open for more or less time depending on the fuel quantity delivered.

By contrast, if the pressure control valve is actuated, i.e. the electromagnet is supplied with current, then the pressure in the high-pressure circuit increases. To that end, a magnetic force is generated in addition to the force exerted by the compression spring. The pressure control valve is closed until a force equilibrium is established between the high-pressure force on the one hand and the spring force and magnetic force on the other. The magnetic force of the electromagnet is proportional to the activation current I of the magnet coils inside the pressure control valve. The activation current I can be pulsed using pulse-to-width modulation.

According to the above-mentioned publication, page 270, FIG. 7, the pressure control valve is flange-mounted, for example laterally, to the high-pressure pump. It is also possible for the pressure control valve and the high-pressure accumulator (common rail) to be sealed on the high-pressure side. In this case, the high-pressure accumulator (common rail) and the pressure control valve are each embodied as a separate respective component. These separately embodied components of the accumulator injection system, however, are costly to produce because their high-pressure side sealing locations require precision machining. In addition, the high-pressure side sealing locations must be provided with sealing elements capable of withstanding the mechanical stresses that occur at the high-pressure side sealing locations. With operation over time, the pressure level prevailing on the high-pressure side inevitably causes leaks to occur at the sealing locations disposed on the high-pressure side.

In addition, space problems can arise because lines are required between the high-pressure accumulator and the pressure control valve due to the size and installation orientation of these accumulator injection system components within the space. If separate components are joined, then their installation inside the engine compartment, in the cylinder head region of an autoignition internal combustion engine is difficult and the installation is time-consuming. In addition, temperature problems with regard to the control seat can arise when the components, i.e. the high-pressure accumulator and pressure control valve, are sealed off from each other on the high-pressure side. The control seat is the point at which a closing element embodied as a ball-shaped closing body is pushed into a seat by an armature part of the pressure control valve. The precise position of this seat, in turn, determines the air gap that is set between the armature plate and an end surface of the magnet core in a pressure control valve that is controlled by a solenoid valve. The more precisely the air gap between these components of the pressure control valve can be embodied, the more precisely a pressure difference $\Delta p$ can be produced in accordance with a tolerance that is set in the pressure control valve. If the seat surface into which the ball-shaped closing element is pressed is deformed by an impermissibly intense heating due to an uneven temperature distribution, then after extended operation and the attendant temperature increase in the high-pressure accumulator, a change in the air gap occurs due to the changing air gap of the magnetic components inside the pressure control valve. The pressure tolerance $\Delta p$, which is proportional to the magnetic flux I, is therefore subjected to a negative influence, thus reducing the control precision of an accumulator injection system comprised of separate components that are sealed in relation to one another on the high-pressure side.

SUMMARY OF THE INVENTION

The design proposed according to the invention makes it possible for the sealing location between the high pressure-carrying structural components of an accumulator injection system, namely between the high-pressure accumulator and the pressure control valve, to be relocated from the sealing critical high-pressure side to the less critical low-pressure side.

Installing the pressure control valve in the high-pressure accumulator with a low-pressure side seal makes it possible to eliminate a high-pressure side seal, which is subjected to high mechanical stresses that inevitably cause the seal to leak. The seat for the closing element, e.g. embodied as a valve ball in the pressure control valve, can be relocated to an end of the high-pressure accumulator. This provides for favorable heat dissipation since the seat is embodied as solid, which permits a favorable transmission of heat in the material of the high-pressure accumulator. Since the design according to the invention makes it possible to achieve a homogeneous temperature distribution in the high-pressure accumulator, there is no longer a decrease in the material hardness due to intense heating, thus considerably increasing the strength of the high-pressure accumulator that is designed according to the invention. Another advantage lies in the fact that it is no longer necessary to provide a circulation around the seat. In prior embodiments of a high-pressure accumulator, a circulation around the seat, by cooling the seat region inside the low-pressure circuit, served to cool this circuit in order to prevent it from heating up in an impermissible manner. However, this circulation around the seat required additional connections inside the low-pressure circuit, which can now be eliminated with the design according to the invention.

In an embodiment variant of the design according to the invention, the seat for the closing element that is to be controlled by the pressure control valve can be incorporated into the end of the high-pressure accumulator. In this instance, in order to produce a low-pressure chamber between the high-pressure accumulator and the pressure control valve, a blind hole bore, which is easy to produce from a production engineering standpoint, is provided at the end of the high-pressure accumulator. The circumferential surface of the blind hole bore advantageously contacts an end surface on the pressure control valve, thus producing another material connection that constitutes a possibility for heat dissipation.

Another embodiment variant is comprised in the fact that the seat for the closing element of the pressure control valve is embodied in an insert piece if it is preferable for the cavity of the high-pressure accumulator to be embodied as uniformly continuous. The insert piece containing the valve seat can be press-fitted or welded into the cavity of the high-pressure accumulator. In this embodiment variant as well, the end of the insert piece oriented away from the end of the pressure control valve constitutes a low-pressure chamber in which the low-pressure side seal can be provided. Both the end of the high-pressure accumulator in the first embodiment mentioned and the insert piece with the valve seat in this instance can have a through bore containing a throttle restriction, which is closed by the closing element that is acted on by the pressure control valve.

After the pressure control valve is inserted into one of the ends of the high-pressure accumulator, the pressure control function in the pressure control valve is set according to a required pressure tolerance $\Delta p=f(I)$, where I=activation current (pressure control valve) and the air gap is set for an actuating component of the pressure control valve, which component is embodied, for example, in the form of a solenoid valve.

BRIEF DESCRIPTION OF THE DRAWINGS

The invention is explained in detail below, in conjunction with the drawings, in which.

DESCRIPTION OF THE PREFERRED EMBODIMENTS

Figure 1:
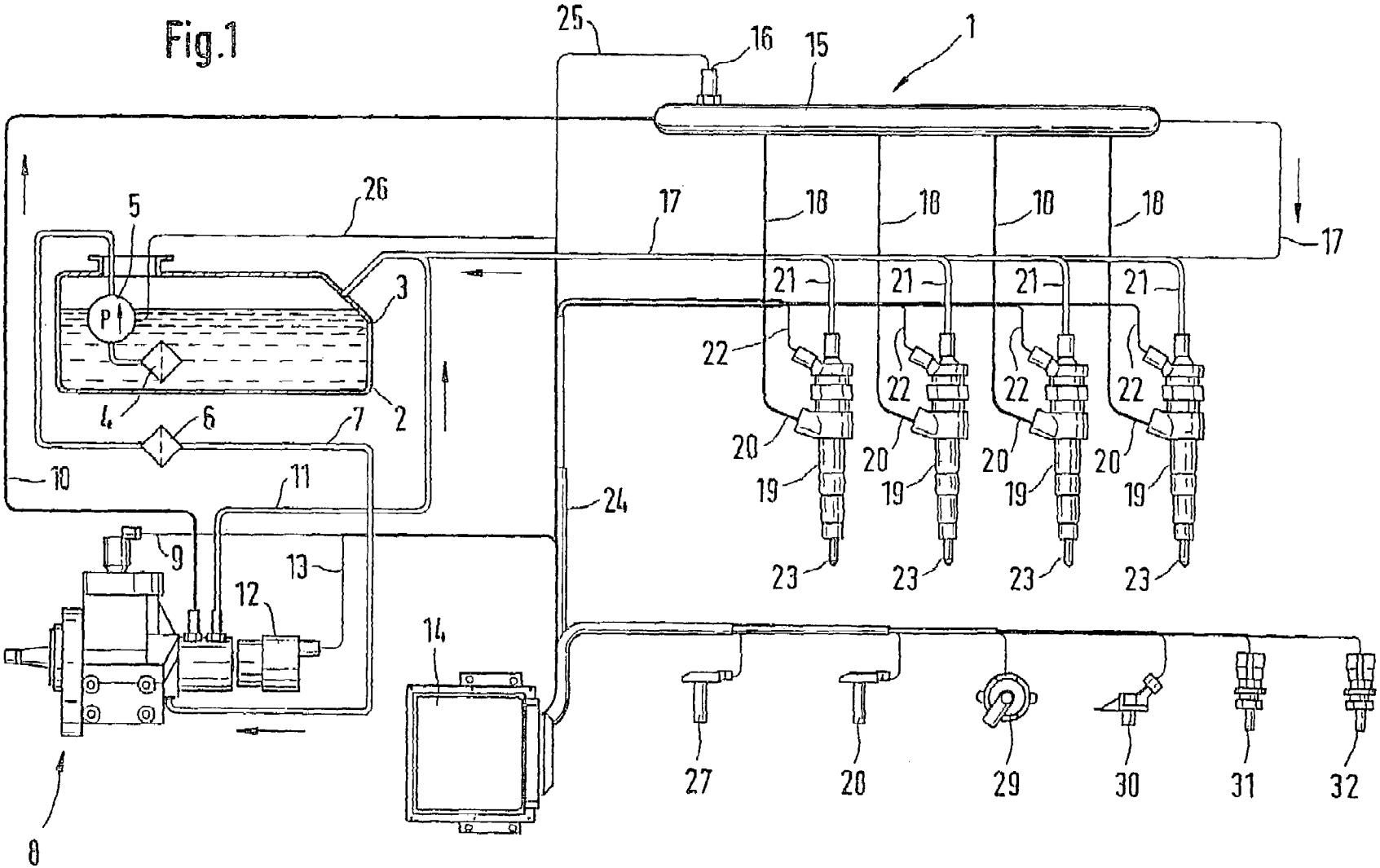
FIG. 1 shows the components of an accumulator injection system with a high-pressure accumulator.

FIG. 1 shows the components of a fuel injection system with a high-pressure accumulator.

The fuel injection system 1 shown in FIG. 1 includes a fuel tank 2 that contains fuel at a fuel level 3. Below the fuel level 3 inside the fuel tank 2, there is a preliminary filter 4, which is disposed upstream of a presupply unit 5. The presupply unit 5 delivers the fuel, which has been drawn through the preliminary filter 4 from the fuel tank 2, through a fuel filter 6, into a low-pressure line segment 7 that feeds into a high-pressure delivery unit 8. Via a control line 9, a central control unit 14, which is only depicted schematically here, controls the high-pressure delivery unit 8, which can be a high-pressure pump, for example. In addition to the connection of the low-pressure line connection 7, the high-pressure delivery unit 8 has a pressure control valve 12 flange-mounted to it which is likewise controlled by the central control unit 14 an electrical connection 13. The high-pressure delivery unit 8 has a high-pressure supply line 10 branching from it via which highly pressurized fuel is supplied to a tubular high-pressure accumulator 15 (common rail). The high-pressure delivery unit 8 also has a fuel return line 11 branching from it, which feeds into a return 17 that carries the excess flow of fuel back into the fuel tank 2.

The very highly pressurized fuel that the high-pressure delivery unit 8 supplies via the high-pressure supply line 10 travels into the high-pressure accumulator 15 (common rail), which can be provided with a pressure sensor 16 on its outer circumference. The pressure sensor 16 is connected via a pressure signal line 25 to a central signal line 24 extending out from the control unit 14. A number of high-pressure lines 18 that corresponds to the number of fuel injectors 19 branches off from the high-pressure accumulator 15, which can be embodied as a tubular component, for example. The high-pressure supply lines 18 are each connected to a respective inlet connection 20 of the injector body of the fuel injectors 19. The fuel injectors 19 include actuators that can be embodied, for example, in the form of piezoelectric actuators, mechanical-to-hydraulic transmission devices, or solenoid valves and that initiate the injection events in the appropriate sequence. Via actuator control lines 22, the actuators of the individual fuel injectors 19 are likewise connected to the central signal line 24 extending out from the schematically depicted control unit 14. The individual fuel injectors 19 also have return lines 21, which likewise feed into the above-mentioned return 17 to the fuel tank 2 so that control volumes to be diverted can flow into the fuel tank 2.

In addition to the previously mentioned control line 13 for controlling an electromagnet contained in the pressure control valve 12, a control line 9 for the high-pressure delivery unit 8, and a pressure sensor line 25 leading to the pressure sensor 16 of the high-pressure accumulator 15, the control unit 14 also has a control line 26 branching from it, which is used to control the presupply unit 5 mounted in the fuel tank 2. The central control unit 14 of the fuel injection system also receives signals from a crankshaft sensor 27 that detects the rotational position of the internal combustion engine, signals from a camshaft sensor 28 that can determine the corresponding phase position of the engine, and input signals of an accelerator pedal sensor 29. Via the central signal line 24, the central control unit 14 also receives signals that characterize the boost pressure 30 from a corresponding sensor mounted in the intake section of the engine. The motor temperature 31, for example detected at the walls of the combustion chambers of the engine, and the temperature 32 of the engine coolant are transmitted via the central signal line 24 to the central control unit 14 shown in FIG. 1.

Figure 2:
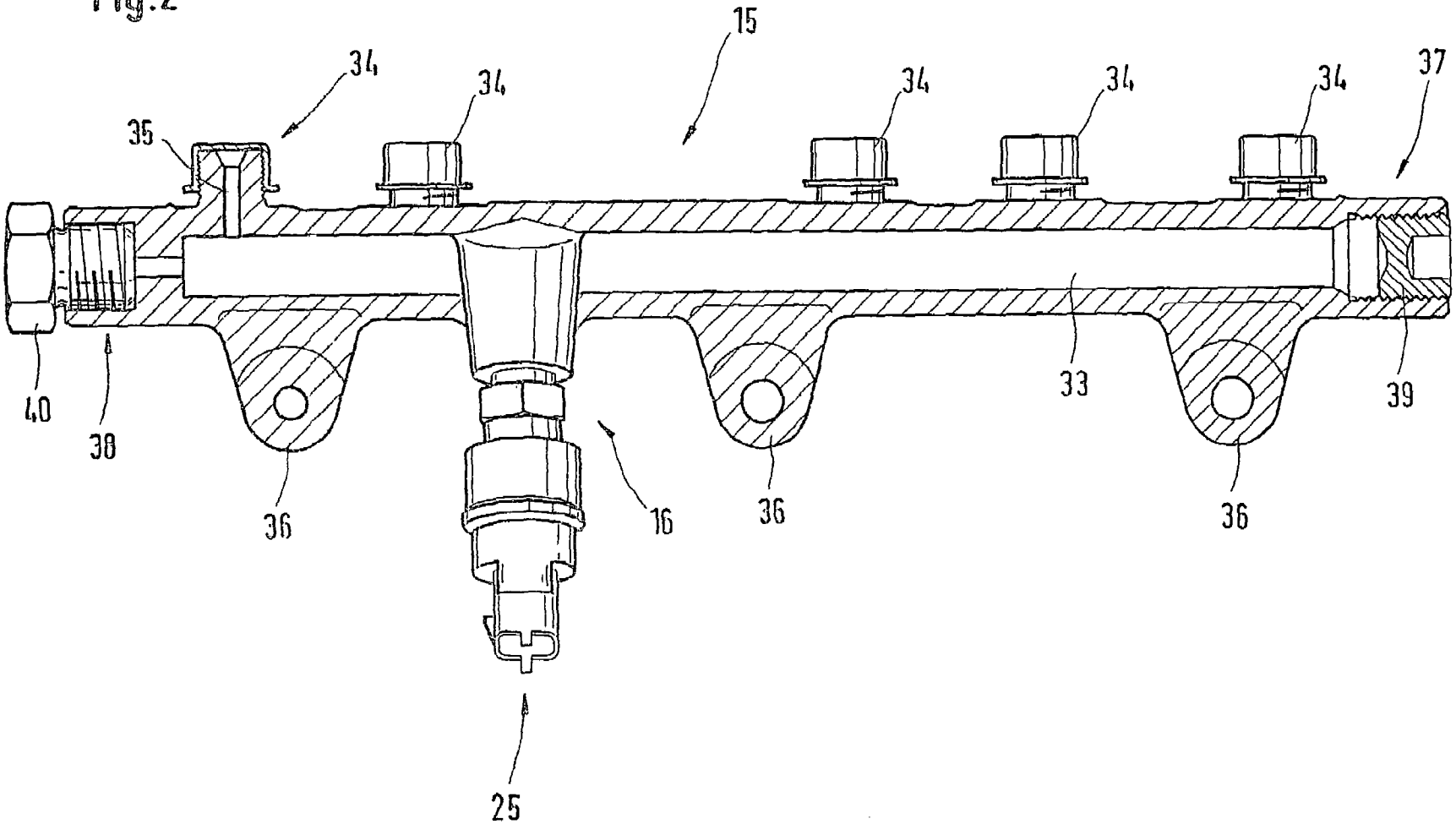
FIG. 2 shows a longitudinal section through the high-pressure accumulator of FIG. 1.

The high-pressure accumulator 15 encloses essentially one cavity 33. The high-pressure accumulator 15 shown in FIG. 2 is embodied as a separate component and includes an insert element 39 embodied as a stopper at its first end 37, which can be connected to the return 17 to the fuel tank that is depicted in FIG. 1. At its second end 38, the high-pressure accumulator 15 according to the depiction in FIG. 2 has a high-pressure connection 40 to which the high-pressure supply line 10 shown in FIG. 1 can be connected. The pressure sensor 16 shown in FIG. 1 is mounted to the outer circumference of the high-pressure accumulator and is connected to the control unit 14 via the pressure sensor line 25 shown in FIG. 1 (see depiction according to FIG. 1).

The circumferential surface of the high-pressure accumulator 15 is provided with connection fittings 34 to which the high-pressure supply lines 18 to the individual fuel injectors 19 can be connected and the number of which corresponds to the number of fuel injectors 19 to be supplied with fuel by means of the high-pressure accumulator 15 (see depiction according to FIG. 1). The connection fittings 34 contain respective lateral bores 35 connected to the cavity 33 of the high-pressure accumulator 15 and via these lateral bores 35, supply highly pressurized fuel from the high-pressure accumulator 15 to the individual fuel injectors 19. The outer circumference of the high-pressure accumulator 15 according to the depiction in FIG. 2 also has fastening lugs 36 forged or welded onto it, which permit the high-pressure accumulator 15 to be attached to an autoignition internal combustion engine in its cylinder head region.

The high-pressure accumulator 15 shown in FIG. 2 has five connection fittings 34 so that five high-pressure supply lines 18 to the fuel injectors 19 of an autoignition internal combustion engine can be supplied with highly pressurized fuel. The high-pressure accumulator 15, which is embodied as a separate component in FIG. 2, can naturally also be designed to supply fuel to a four-cylinder autoignition engine as well as to a six-cylinder or eight-cylinder engine.

Figure 3:
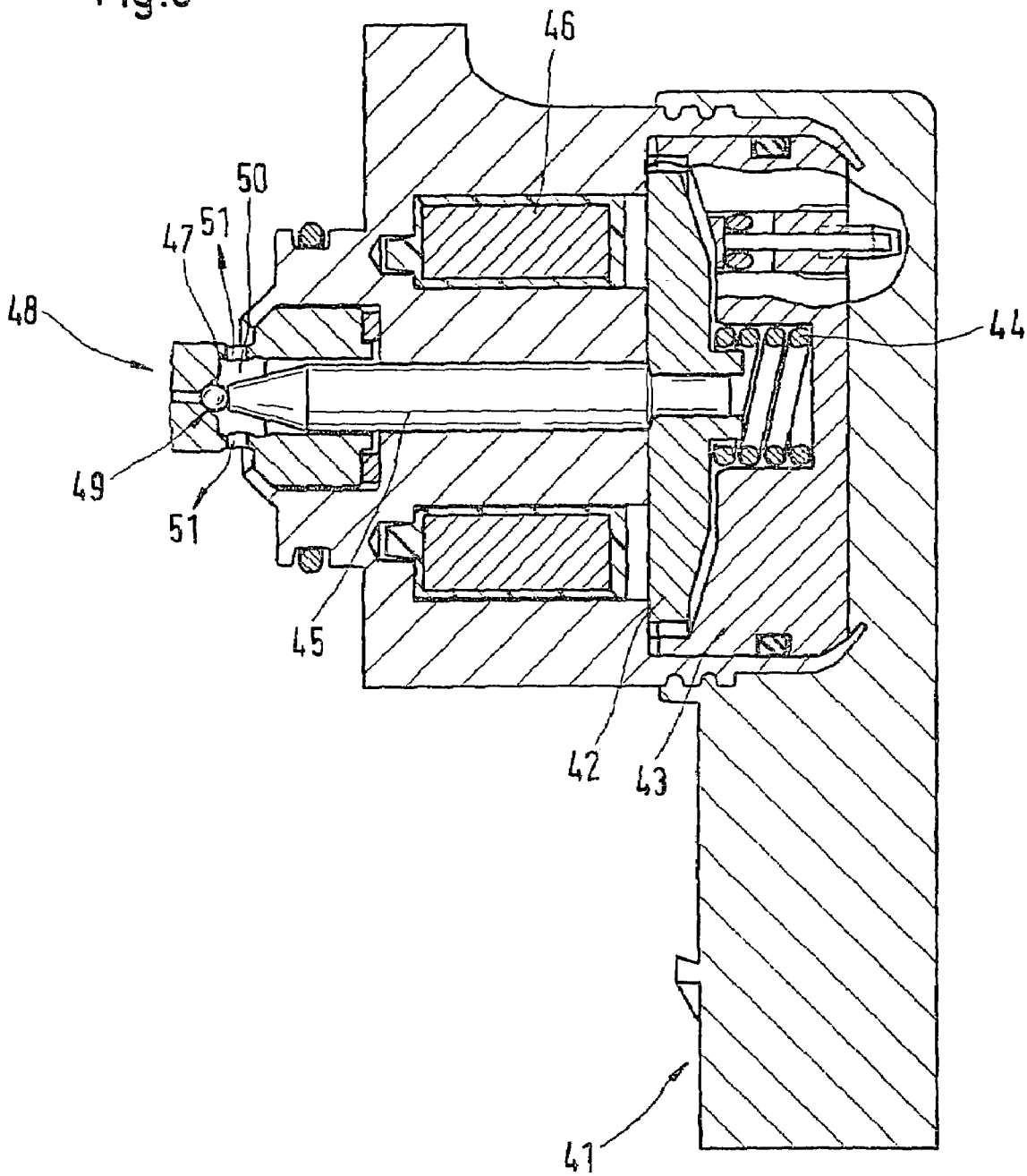
FIG. 3 shows a high-pressure accumulator on the high-pressure side sealed, electrically controlled pressure control valve.

FIG. 3 shows an electrically controlled pressure control valve sealed on the high-pressure side of the high-pressure accumulator.

The pressure control valve depicted in a sectional view in FIG. 3 has an electrical connection 41, which can be clipped onto annular grooves of a housing body or is injection molded onto it. The housing body contains an electromagnet 46. Opposite from the electromagnet 46 is an armature plate 42 that is acted on by a compression spring 44. The armature plate 42 and the compression spring 44 are enclosed by an approximately bell-shaped insert piece 43. The armature plate 42 is connected to an armature piece 45, which has a tapered region in the form of a truncated cone at its end oriented away from the armature plate 42. The tapered end of the armature piece 45 acts on a closing element 47 embodied here as a valve ball, which fits into a valve seat 49. The conically tapered region of the armature piece 45, which acts on the closing element 47 embodied in the form of a ball, is encompassed by a low-pressure side chamber 50, which contains openings 51 through which fuel, which comes out of the high-pressure side when the closing element 47 is actuated, is returned into the low-pressure region and possibly to the fuel tank of the fuel injection system. The pressure control valve depicted in a sectional view in FIG. 3 is provided with a high-pressure side seal 48 which allows the pressure control valve to be placed against a high-pressure delivery unit of a high-pressure pump or against a high-pressure accumulator. The high-pressure side seal 48 required high quality machining and extremely low tolerances and, during operation, is subjected to extremely high mechanical stresses, thus representing, over an increasing service life, a weak point in a fuel injection system for autoignition internal combustion engines.

Figure 4:
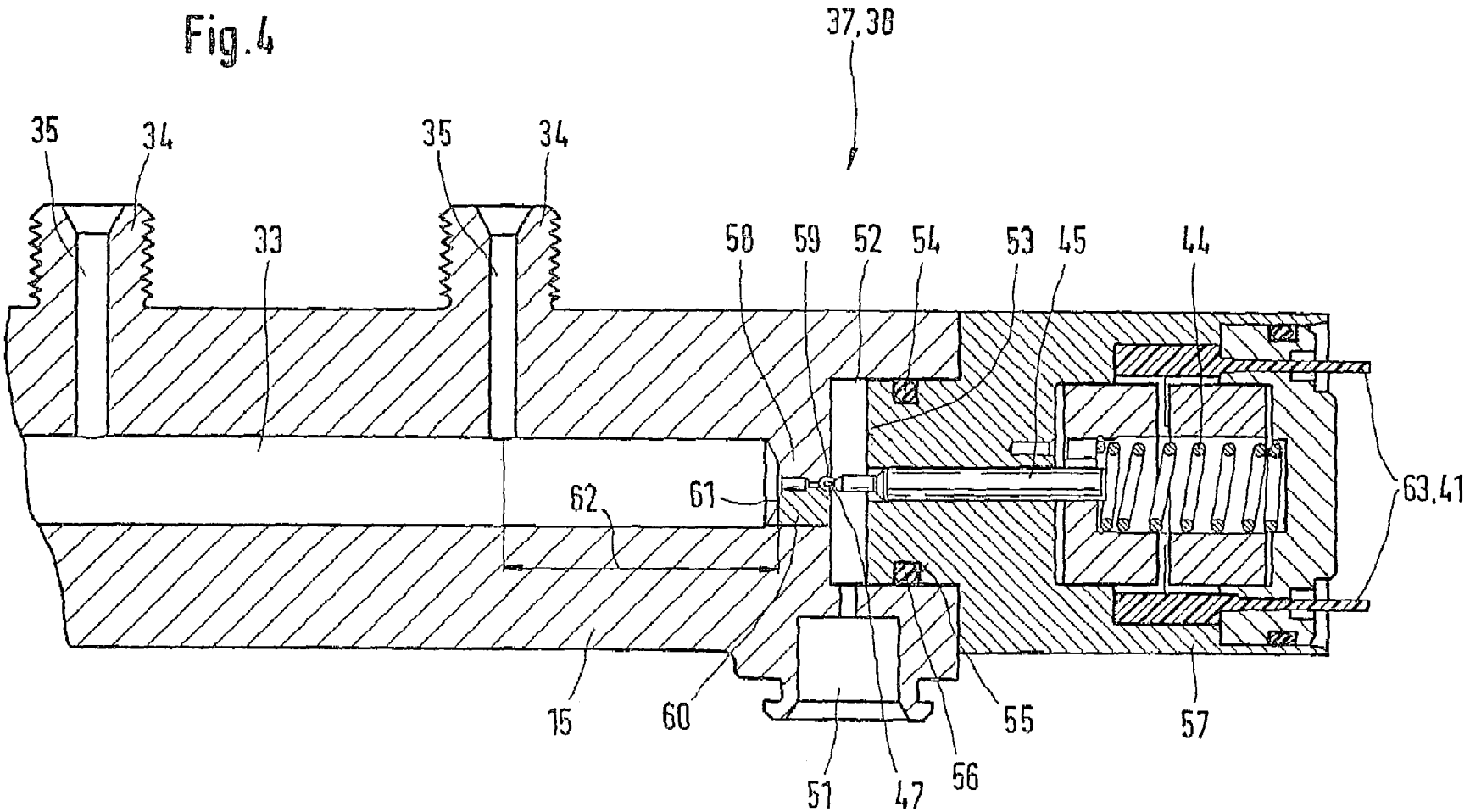
FIG. 4 shows a pressure control valve, which is sealed on the low-pressure side of the high-pressure accumulator.

The depiction in FIG. 4 shows a longitudinal section through both the high-pressure accumulator 15 and the pressure control valve 57.

The high-pressure accumulator 15 is embodied with a wall thickness that is adapted to the pressure level prevailing in it. In accordance with the number of fuel injectors 19 to be supplied with fuel in an autoignition internal combustion engine, the outer circumferential surface of the high-pressure accumulator 15 is provided with a number of connection fittings 34 that each have a lateral bore 35 passing through them. The highly pressurized fuel flows out of the cavity 33 of the high-pressure accumulator 15, through the lateral bores 35 in the connection fittings 34, and into the respective high-pressure supply lines 18 leading to the injectors 19, which inject the fuel into the combustion chambers of the engine to be fed.

A bore 52 embodied in the form of a blind hole, for example, is provided at one end of the high-pressure accumulator 15 and serves to contain the pressure control valve 57. The blind hole bore 52 at one end of the high-pressure accumulator 15 constitutes a low-pressure region when a pressure control valve 57 is installed in it. The low-pressure region is associated with a low-pressure connection 51, via which fuel in the low-pressure region of the fuel injection system, which comes out of the cavity 33 of the high-pressure accumulator 15 and flows into the low-pressure region 52, 51, can flow into a return 17, for example, and then back into the fuel tank (see depiction according to FIG. 1). The pressure control valve 57 shown in FIG. 4 is embodied as seatless and has an end 53 that has a smaller diameter than the outer diameter of the pressure control valve 57. Inside the smaller diameter region of the pressure control valve 57, an annular groove 55 can be provided, into which a sealing element 56 can be inserted. The sealing element 56 inserted into the annular groove 55 constitutes a low-pressure side seal 54 inside the low-pressure region 51, 52, which seal is subjected to significantly less intense compression stresses than a seal on the high-pressure side (see depiction according to FIG. 3, position 48). Instead of the position of the annular groove 55 shown in FIG. 4, which contains the sealing element 56, a recess could also be provided in the region of the end surface of the pressure control valve body that contacts the annular surface encompassing the blind hole 52 in the high-pressure accumulator 15. The low-pressure side sealing surface could consequently be relocated into the abutting contact region between the annular section that delimits the blind hole 52 and the larger diameter body of the pressure control valve 57. Both of the low-pressure side seals 54 shown by way of example are subjected to less intense mechanical stresses than a high-pressure side sealing location 48 between the pressure control valve 57 and the high-pressure accumulator 15. In addition, the placement of a pressure control valve 57 shown in FIG. 4 directly against a high-pressure accumulator 15 either on a first end 37 or a second end 38 makes it possible to eliminate a line connection between the high-pressure accumulator and the pressure control valve.

Analogous to the pressure control valve shown in the sectional view in FIG. 3, the pressure control valve 57 has an armature piece 45, whose end oriented away from the compression spring 44 acts on the closing element 47 that is embodied here in the form of a ball. The ball-shaped closing element 47 shown in FIG. 4 cooperates with a valve seat 59 or 61.

In a first embodiment variant of the design proposed according to the invention, the seat 59 can be incorporated directly into an end wall 58 of the high-pressure accumulator 15. In this embodiment variant, i.e. with a one-piece high-pressure accumulator 15, the cavity 33 of the high-pressure accumulator 15 is delimited by the end 58, which has a bore passing through it that contains a throttle restriction immediately upstream of the closing element 47. The closing body 47 that the armature piece 45 of the pressure control valve 57 presses into the valve seat 59 can be used to relieve the pressure in the cavity 33 of the high-pressure accumulator 15. The opening of the cavity 33, which can be opened and closed by the ball-shaped closing element 47, is disposed with its end oriented toward the cavity 33 a certain distance 62 from the symmetry line of the lateral bore 35 of a first high-pressure connection 34. The distance 62 between the lateral bore 35 of the first high-pressure connection 34 and the end of the high-pressure accumulator 15 is dimensioned so as to reduce mechanical stresses inside the pressure control valve 15 between the lateral bore 35 and the end of the high-pressure accumulator 15.

The valve seat 59 for the closing element 47 embodied in the end 58 of the high-pressure accumulator 15 has the particular advantage that the valve seat 59 is provided in a solidly embodied region. When heat is generated as a result of the high pressures, a uniform temperature distribution can occur, i.e. a uniform transmission of heat into the material surrounding the valve seat 49, so that no reduction in material hardness or impermissibly high material stresses can occur that might have a negative impact on the calibration of the pressure control valve 57, which is executed at a normal temperature; the pressure control valve 57 here is preferably actuated by an electromagnet 46. This consequently prevents a shifting of the pressure tolerance $\Delta p=f(I)$, where I=magnetic flux. The embodiment of a pressure control valve 57 that is integrated into the high-pressure accumulator 15 as shown in FIG. 4 permits a calibration, i.e. the setting of an air gap in the electromagnet of the pressure control valve 57, in order to adjust the tolerance characteristic curve $\Delta p=f(I)$ when the pressure control valve 57 is mounted onto the high-pressure accumulator.

In a second embodiment variant of the design proposed according to the invention, in two-part or multi-part high-pressure accumulators 15, an insert part 60 can be press-fitted or welded into the cavity 33 in order to delimit the cavity 33. In this embodiment variant of the design proposed according to the invention, a valve seat 61 can be incorporated into the insert part 60. The end of the insert part 60 oriented toward the high-pressure accumulator 33 is preferably also disposed spaced a distance 62 apart from the symmetry line of the lateral bore 35 of the first high-pressure connection 34.

When the insert part 60 is press-fitted or welded into the cavity 33, there is likewise a connection to the solid material of the high-pressure accumulator 15 that permits a favorable transmission of heat so that the heating that occurs in the precisely machined valve seat 61 cannot cause any distortion of the seat 61 inside the insert part and consequent shifting of the characteristic curve of the pressure control valve 57.

Furthermore, both of the above-described embodiment variants, in which a seatless pressure control valve 57 is placed in a bore embodied as a blind hole 52 in a high-pressure accumulator 15, have a heat bridge such that the material of the high-pressure accumulator 15 surrounding the blind hole bore 52 contacts an end surface of the body of the pressure control valve 57 and thus can aid in the removal of heat from the pressure control valve 57 or its outer circumference surface. The body of the pressure control valve 57, whose end oriented away from the end surface 53 can be provided with electrical connections 63 or 41, has a region with a tapered diameter, preferably in the region of the end surface 53, into which an annular groove 55 can be incorporated, which contains the sealing element 56 of the low-pressure side seal 54. The low-pressure side region 52, 51 containing the seal 54 is essentially delimited by the blind hole bore 52 at one of the ends of the high-pressure accumulator 15 and the bottom of the blind hole bore 52 in which the valve seat 59 for the closing element 47 is disposed in one-piece high-pressure accumulators 15 or in which the valve seat 61 is disposed in multi-part high-pressure accumulators 15 that have an insert part 60 press-fitted or welded into them. According to the design shown in FIG. 4, a high-pressure side seal can be eliminated, thus making it easy to produce a seal between the high-pressure accumulator 15 and the pressure control valve 57. In addition, the placement of the seat 59 or 61 for the ball-shaped closing element 47 given in the two embodiment variants makes it possible to achieve a favorable seat cooling since a dissipation of heat can occur via the solid material surrounding the seat 59 or 61. Furthermore, a circulation around the seat can be eliminated in both of the embodiment variants of the design proposed according to the invention.

Moreover, placing the seal between the high-pressure accumulator 15 and the pressure control valve 57 on the low-pressure side reduces the installation forces required. In comparison to a seal on the high-pressure side, which places particular demands on the manufacturing precision and the materials used—particularly in the sealing element, the low-pressure side seal 54 proposed according to the invention can be produced for a significantly lower price in a seatless pressure control valve 57 that is integrated into an end 37 or 38 of the high-pressure accumulator 15 since the pressure level to be sealed is significantly lower.

The foregoing relates to preferred exemplary embodiments of the invention, it being understood that other variants and embodiments thereof are possible within the spirit and scope of the invention, the latter being defined by the appended claims.

The invention claimed is:

1. A fuel injection system for internal combustion engines comprising a high-pressure accumulator (15) that is acted on with highly pressurized fuel by a high-pressure delivery unit (8), and which supplies fuel to fuel injectors (19), a pressure control valve (57), which is disposed between a high-pressure side (33) and a low-pressure side (50, 51), an electrical actuator (46) operable to actuate the pressure control valve (57) to actuate a valve element (47), wherein the pressure control valve (57) has an end surface (53) which is positioned within the high-pressure accumulator and, along with a wall of the high-pressure accumulator delimits a low-pressure chamber (51, 52) within the high-pressure accumulator (15), the low-pressure chamber being sealed by means of a sealing location (54) which is disposed on the low-pressure side.

2. The fuel injection system according to claim 1, wherein the pressure control valve (57) is accommodated in a seat in the high-pressure accumulator (15).

3. The fuel injection system according to claim 1, wherein the high-pressure accumulator is comprised of one piece.

4. The fuel injection system according to claim 1, wherein the high-pressure accumulator is comprised of several pieces.

5. The fuel injection system according to claim 3, wherein the low-pressure region (51, 52) is constituted by the end surface (53) of the pressure control valve (57) and an end surface (58) of the high-pressure accumulator (15).

6. The fuel injection system according to claim 4, wherein the low-pressure region (51, 52) is constituted by the end surface (53) of the pressure control valve (57) and an insert part (60) that delimits the cavity (33) of the high-pressure accumulator (15).

7. The fuel injection system according to claim 5, wherein the low-pressure region (51, 52) has a low-pressure side connection fitting.

8. The fuel injection system according to claim 6, wherein the low-pressure region (51, 52) has a low-pressure side connection fitting.

9. The fuel injection system according to claim 5, wherein the low-pressure end (58) of the high-pressure accumulator (15) has a seat (59) for the closing element (47), or the insert part (60) has a seat (61) for the closing element (47).

10. The fuel injection system according to claim 6, wherein the low-pressure end (58) of the high-pressure accumulator (15) has a seat (59) for the closing element (47), or the insert part (60) has a seat (61) for the closing element (47).

11. The fuel injection system according to claim 6, wherein the insert part (60) is press-fitted into the cavity (33) of the high-pressure accumulator (15).

12. The fuel injection system according to claim 6, wherein the insert part (60) is welded into the cavity (33) of the high-pressure accumulator (15).

13. The fuel injection system according to claim 1, wherein the low-pressure side seal (54) comprises an annular groove (55) that contains a circumferential sealing element (56).

14. The fuel injection system according to claim 1, further comprising a ring of the high-pressure accumulator (15) enclosing the end surface (53) of the pressure control valve (57) and functioning as a heat transmission bridge that contacts the end surface of the body of the pressure control valve (57).

15. The fuel injection system according to claim 9, wherein the seat (59, 61) for the closing element (47) on the high-pressure accumulator (15) is disposed in a region with material properties that encourage heat dissipation.

16. The fuel injection system according to claim 15, wherein the seat (59, 61) for the closing element (47) is disposed in a solid material region.

17. The fuel injection system according to claim 15, wherein the insert part (60), which delimits the cavity (33), or the end surface (58) of the high-pressure accumulator (15) on the high-pressure side is disposed spaced a distance (62) apart from a lateral bore (35) of a first high-pressure connection fitting (34).

* * * * *